US006425236B1

(12) United States Patent
Roquet et al.

(10) Patent No.: US 6,425,236 B1
(45) Date of Patent: Jul. 30, 2002

(54) CABLE AND YARN DOUBLE-TWISTING SPINDLE

(75) Inventors: Xavier Roquet, Duisburg; Heinz Stenmans, Grefrath, both of (DE)

(73) Assignee: Volkmann GmbH (DE)

( * ) Notice: Subject to any disclaimer, the term of this patent is extended or adjusted under 35 U.S.C. 154(b) by 0 days.

(21) Appl. No.: 09/717,794

(22) Filed: Nov. 20, 2000

(30) Foreign Application Priority Data

Nov. 18, 1999 (DE) ..... 199 55 399

(51) Int. Cl.[7] ..... D01H 13/00

(52) U.S. Cl. ..... 57/58.49; 57/100; 57/92

(58) Field of Search ..... 57/58.49, 34 R

(56) References Cited

U.S. PATENT DOCUMENTS 3,975,893 A * 8/1976 Franzen ..... 57/34 R

* cited by examiner

*Primary Examiner*—Rodney M. Lindsey
*Assistant Examiner*—James G Smith
(74) *Attorney, Agent, or Firm*—R W Becker & Associates; R W Becker

(57) ABSTRACT

A cabling and yarn double-twisting spindle having pneumatic assistance for a threading up of the yarns to be handled by the spindle is provided. The spindle includes a shaft rotatably supportable in a support hub on a spindle bank. The shaft has a central, axially extending shaft bore, and package top. The package top is secured against rotation and has a hollow spindle axial portion disposed in communication with the spindle shaft bore. A pressurized air injector effects threading up of a yarn component delivered via the hollow spindle axial portion of the package top with another yarn component delivered via the spindle shaft bore, and includes a pressurized air supply conduit in the spindle shaft such that the pulse of air injected by the air injector is operable to produce a suction flow in the hollow spindle axial portion of the package top and in the spindle shaft bore.

9 Claims, 2 Drawing Sheets

CABLE AND YARN DOUBLE-TWISTING SPINDLE

BACKGROUND OF THE INVENTION

The present invention relates to a cable and yarn double-twisting spindle having a pneumatic yarn threader.

A so-called combination spindle unit, which can be operated in correspondence with the type of yarn as either a double-twisting spindle by which the yarn drawn from the top of one or several yarn feed packages is guided through the hollow spindle axial portion, thereafter radially through a yarn guide channel traveling about a rotation plate with its associated balloon limiter to a central guide eyelet, and subsequently wound as a double-twisted yarn, or as a cable spindle in which the yarn drawn from the top of a feed package, preferably a filament yarn, is guided in the same manner as in the yarn twisting process and is united in the region of the radially traveling yarn channel with a yarn component delivered from below via the spindle shaft channel.

From DE 41 03 286 C2, it is known to provide pressurized air through an injector jet of a twist spindle which is disposed centrally in the rotation plate and which communicates radially with the yarn guide channel such that the supply of pressurized air through the injector jet into the spindle hollow axial portion produces a suction effect operable to thread a yarn, disposed at the upper end of the spindle hollow axial portion, through the spindle hollow axial portion and the yarn guide channel.

A cable spindle described in DE 43 09 474 C1 is provided with a regulating or tension compensating element for regulating or tension compensating, respectively, the yarns of various tensions to be cabled, this element having yarn guide channels and yarn guide rollers comprised in a housing arrangement. To effect threading up of an individual yarn through the housing enclosure, a pressurized air conduit is communicated with each yarn guide channel such that a suction flow is produced in the first section of such yarn guide channels while a pressurized air flow is produced in the next following section of the channels.

SUMMARY OF THE INVENTION

The present invention provides a solution to the challenge of providing a spindle by which such a pneumatic threading up of the respective yarn is possible in both the operation of the spindle as a yarn double-twisting spindle and the operation of the spindle as a cable spindle.

The solution to this challenge is delineated by the features of the spindle as set forth in the claims herein.

In contrast to the yarn twisting spindle described in DE 41 03 286 C2 whose spindle shaft bore is configured solely as a pressurized air supply conduit for the injector jet, the inventive spindle of the present invention is characterized in that the pressurized air path to the injector jet is configured such that additionally in the spindle shaft bore a suction flow is produced for threading up a yarn disposed at the spindle shaft bore and drawn, for example, from a feed package on a frame.

In accordance with one embodiment of the present invention, the spindle shaft is provided with an axial yarn guide channel communicating with the interior of the yarn guide channel of the rotating plate, this axial yarn guide channel being encircled by a ring channel terminating at a spacing below the yarn guide channel of the rotating plate operable to guide pressurized air therethrough and on whose upper end eccentrically oriented channel segments leading to the injector jets are communicated.

In accordance with another embodiment of the present invention, it is provided that the pressurized air is guided not axially through the spindle shaft but is guided, instead, radially through the support hub in that the hub is provided with a lateral pressurized air throughbore which communicates with a ring space surrounding the spindle shaft which itself is communicated with the injector jet via a substantially axially oriented pressurized air channel segment.

BRIEF DESCRIPTION OF THE DRAWINGS

FIG. 1*a* is a radial top sectional view taken along line Ia—Ia in FIG. 1.

DETAILED DESCRIPTION OF THE PREFERRED EMBODIMENTS

Figure 1:
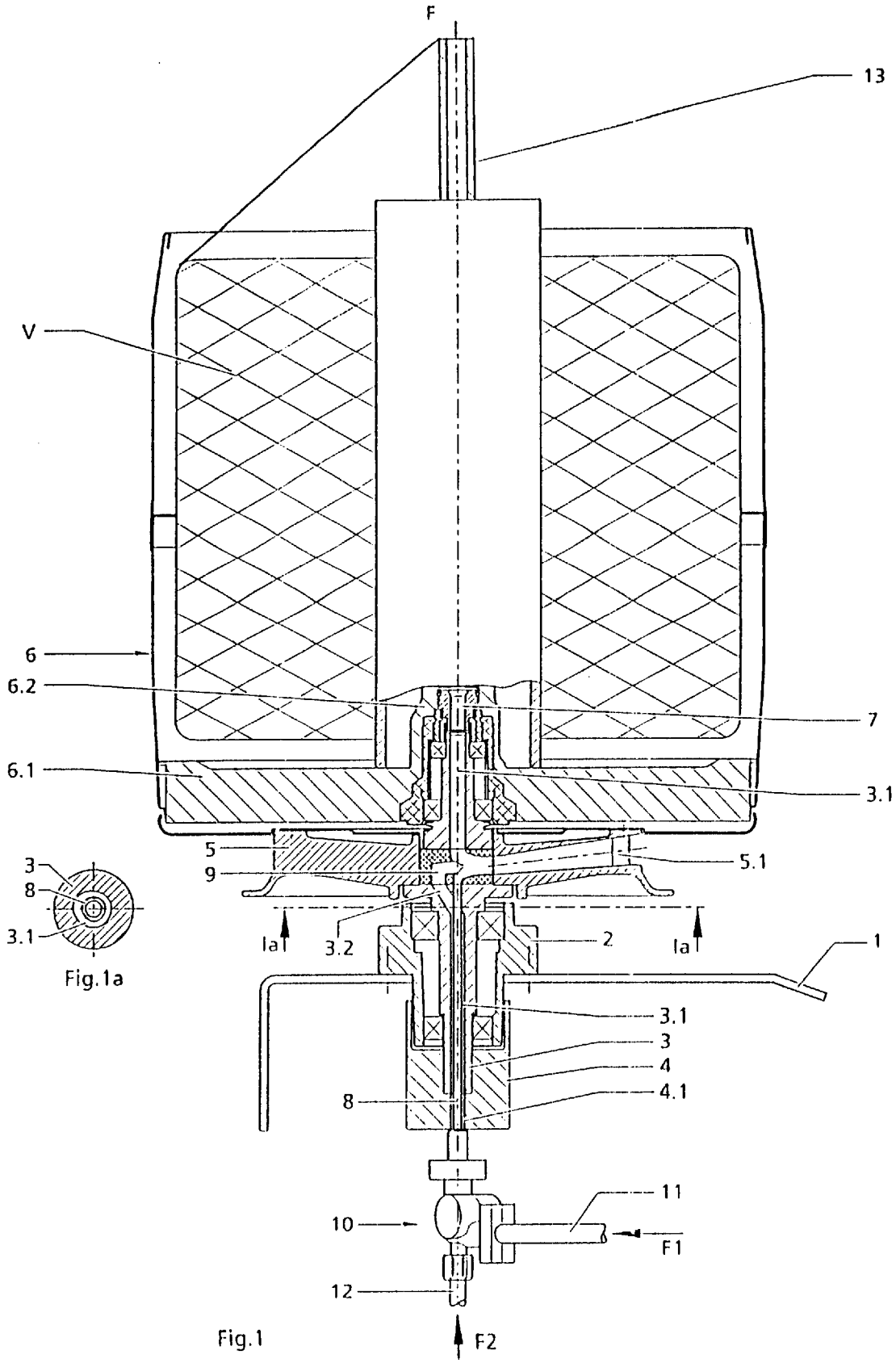
FIG. 1 is a vertical sectional view of one embodiment of the spindle of the present invention.

The embodiment of the spindle of the present invention shown in FIG. 1 is configured as a yarn double-twisting spindle having, in addition to the conventional not further identified or described support elements, a support hub 2 mounted on a spindle bank 1 and having rotatably mounted therein a hollow spindle shaft 3 forming therein a spindle shaft bore 3.1, the spindle shaft 3 being rotatably drivable by a spindle whorl 4. The hollow spindle shaft supports a rotatable plate 5 configured as a yarn storage disk, the rotatable plate having a radially oriented yarn channel 5.1 communicated with the spindle shaft bore 3.1. A package top 6 is mounted on the spindle shaft 3 in a conventional mounting manner so as to be fixed against rotation, the package top having a winding package support floor 6.1. The winding package support floor 6.1 has, as is conventional, a support hub 6.2 to which is connected a hollow spindle axle 7 which lies along an extension of the upper portion of the spindle shaft bore 3.1 and, as such, is in communication with the yarn channel 5.1. The spindle whorl 4 is provided with a bore 4.1 communicating with the spindle shaft bore 3.1.

As seen additionally in FIG. 1*a,* a yarn guide conduit 8 is disposed in the spindle shaft bore 3.1, the yarn guide conduit being encircled by a ring channel which terminates at a spacing below the yarn channel 5.1 and which is operable to guide pressurized air therethrough. An eccentrically oriented or slanted channel segment 3.2 located at the upper end of the ring channel leads to an injector jet 9 disposed substantially centrally with respect to the rotation plate which has its jet opening directed into the yarn channel 5.1. The spindle shaft bore 3.1 terminates at a spacing below the radially extending yarn channel 5.1 and merges thereat into the channel segment 3.2.

A coupling element 10 is arranged underneath the spindle which is, as seen in FIG. 1, connectable to the lower end of the whorl bore 4.1, the whorl bore 4.1 additionally being adapted to receive therein the yarn guide conduit 8 which is introduced into the whorl bore via the entrée provided by an annular clearance.

The coupling element 10 is provided with a yarn channel 11 connectable with the yarn guide conduit 8 for receiving therethrough a yarn component (arrow F1) drawn from a not illustrated feed package on a frame and is also provided with a pressurized air channel 12 which is communicated with a not illustrated pressurized air source (arrow F2). The pressurized air channel 12 is communicated, via a not illustrated interconnecting channel, with the ring channel 3.1 of the spindle shaft 3, which encircles the yarn guide conduit 8, for the purpose of assisting in the threading up of a yarn.

If pressurized air is introduced into the injector jet 9, a suction flow is produced in the hollow spindle axial portion 7, which is disposed in an extension of the spindle shaft bore 3.1, as well as in the yarn guide conduit 8—and, thus, in the yarn channel 11 leading to the yarn guide conduit 8—such that a yarn component on the upper end of the yarn guide conduit 13 lying along an extension of the hollow spindle axial portion 7 and a yarn component disposed at the yarn channel 11 are drawn by suction into the spindle. This suction action effects as well the splicing together of the thus drawn in yarn components which are then urged through the yarn channel 5.1 under the force of pressurized air, subsequently guided in their spliced together condition in a balloon configuration through a not illustrated centering eye disposed on an extension of the hollow spindle axial portion, and thereafter wound onto a winding package as a cabling yarn or a double-twisting yarn in correspondence with a combined double-twisting/cabling process.

In the event of operation of the spindle in a yarn double-twisting process, it is to be understood that the yarn component which is drawn from a feed package on a frame and guided into the spindle from below is not present and that the spindle serves as a double-twisting spindle for double-twisting spinning yarn drawn from one or more feed packages disposed in the package top 6.

In the event of operation of the spindle as a cabling spindle, a yarn supply (spindle top supply) is stationarily mounted over the rotating spindle and the yarn is drawn therefrom over the top without rotation distribution.

The yarn drawn from the second likewise stationary yarn supply (frame supply) is guided through the hollow spindle shaft as a balloon around the first supplied yarn.

In the event of axial drawing off of yarn, both strands are wound about each other without the imparting of rotation to one of the strands. In this manner, a rotation of the spindle effects a cabling rotation.

Figure 2:
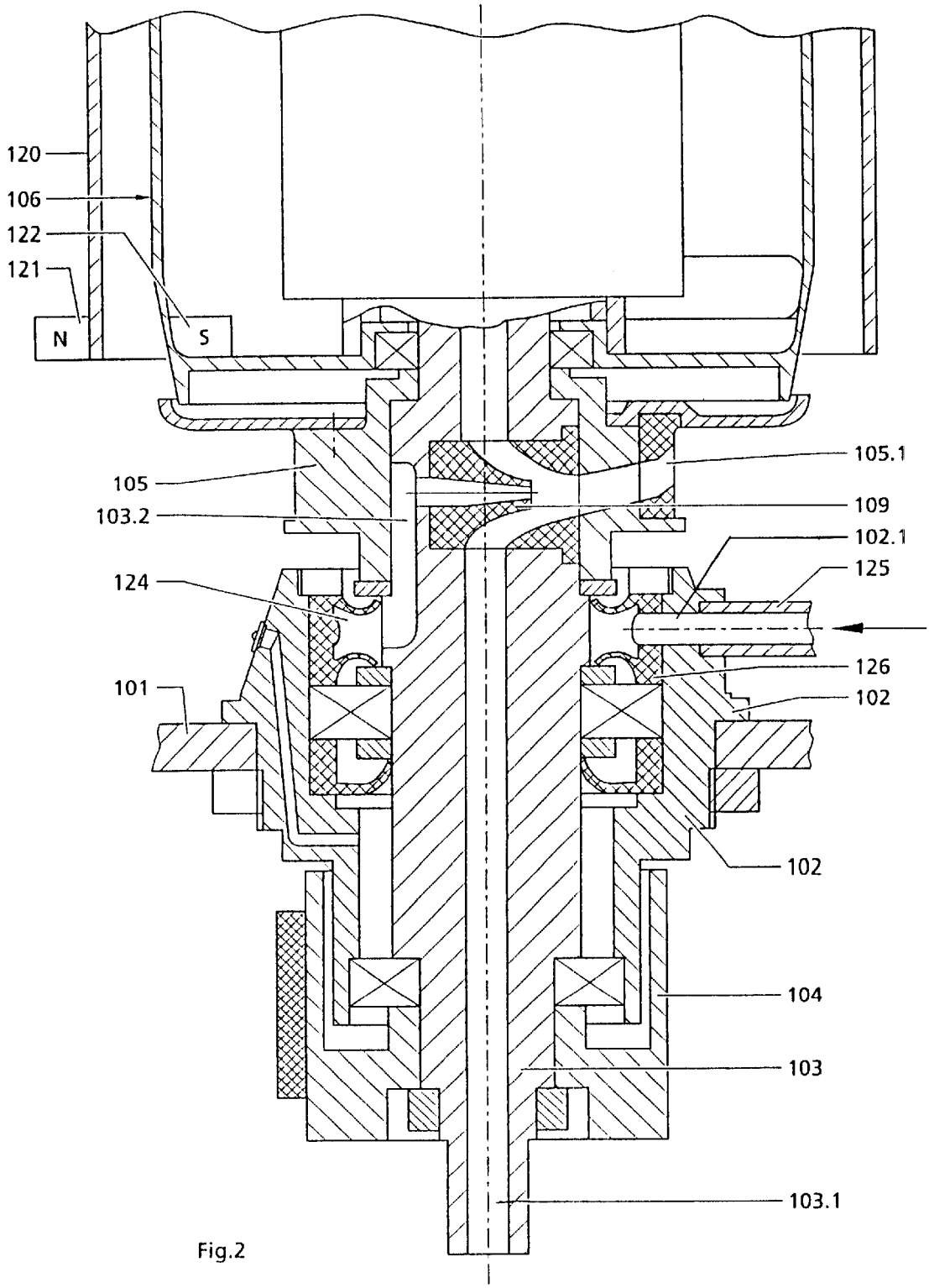
FIG. 2 is a vertical sectional view of another embodiment of the spindle of the present invention.

The spindle illustrated in FIG. 2 comprises a support hub 102 mounted in a spindle bank 101 and a hollow spindle shaft 103, which has a spindle shaft bore 103.1 therein, supported on the support hub 102 by conventional support elements. The spindle shaft 103, which is fixedly mounted relative to the whorl 104 for rotation therewith, supports, and secures for rotation therewith, a rotation plate 105 which has a radially extending yarn channel 105.1 that is communicated with the spindle shaft bore 103.1.

A package top 106, operable to receive a feed package, is disposed on the upper end of the hollow spindle shaft, in the same manner as hereinabove described with respect to the embodiment illustrated in FIG. 1, and a balloon limiter 120 encircles the package top 106, which is secured against rotation by retaining magnets 121, 122.

The spindle shaft bore 103.1 of the embodiment illustrated in FIG. 2 serves solely as a yarn channel for guiding therethrough a yarn component drawn from a not illustrated feed package on a frame.

The support hub 102 is provided with a lateral pressurized air throughbore 102.1 which communicates with a ring chamber 124 that encircles the spindle shaft 103, the ring chamber being sealed off on all sides save for the surface thereof which is oriented toward the spindle shaft. The spindle shaft is communicated with the ring chamber via an axially extending pressurized air channel 103.2 which leads to the injector 109; the pressurized air channel 103.2 is formed by a recess of limited length configured along the outer periphery of the spindle shaft. A pressurized air intermediary conduit 125 is connected to the outward end of the pressurized air throughbore 102.1 and leads to a not illustrated pressurized air source.

The ring chamber 124 is, as shown, disposed between the uppermost radial bearing 126, which acts to the support the spindle shaft in support hub 102, and the rotation plate 105.

The pressurized air channel 103.2 which leads to the injector 109 can alternatively be configured with a radial portion disposed in the spindle shaft and communicating with the ring chamber, and an axial portion communicating with the radial portion and closed off to the outer periphery of the spindle shaft.

The sealing off of the ring chamber on substantially all of its sides can be accomplished in a suitable manner via sealing elements including, especially, lip sealing elements.

The yarn threading up either for operation on the one hand as a cabling spindle or for operation on the other hand as a yarn double-twisting spindle is performed in accordance with the hereinabove described manner that has been described in connection with FIG. 1.

The specification incorporates by reference the disclosure of German priority document 199 55 399.8 of Nov. 18, 1999.

The present invention is, of course, in no way restricted to the specific disclosure of the specification and drawings, but also encompasses any modifications within the scope of the appended claims.

What we claim is:

1. A cabling and yarn double twisting spindle having pneumatic assistance for a threading up of the yarns to be handled by the spindle, comprising:

a spindle shaft rotatably supportable in a support hub on a spindle bank, the spindle shaft having a central, axially extending spindle shaft bore;

a package top secured against rotation and having a hollow spindle axial portion disposed in communication with the spindle shaft bore;

a rotation plate secured to the spindle shaft for rotation therewith, the rotation plate having a radially extending yarn channel communicated with the upper end of the spindle shaft bore and with the lower end of the hollow spindle axial portion of the package top; and a pressurized air injector for injecting a pulse of air to effect a threading up of a yarn component delivered via the hollow spindle axial portion of the package top with another yarn component delivered via the spindle shaft bore, the pressurized air injector including a pressurized air supply conduit disposed within the spindle shaft such that the pulse of air injected by the pressurized air injector is operable to produce a suction flow in the hollow spindle axial portion of the package top and in the spindle shaft bore, wherein the spindle shaft includes an interior yarn channel and a ring chamber encircling the interior yarn channel at a spacing below the upper end of the interior yarn channel, the ring chamber being communicated by a channel with the injector.

2. The spindle according to claim 1, wherein the spindle shaft includes an axially extending step bore having its greatest diameter portion at a spacing below the end of the interior yarn channel and the uppermost portion of the step bore communicating with the channel which communicates the ring chamber with the injector and the interior yarn channel extends through the uppermost portion of the step bore at a spacing from the ring chamber.

3. A cabling and yarn double twisting spindle having pneumatic assistance for a threading up of the yarns to be handled by the spindle, comprising:

a spindle shaft rotatably supportable in a support hub on a spindle bank, the spindle shaft having a central, axially extending spindle shaft bore;

a package top secured against rotation and having a hollow spindle axial portion disposed in communication with the spindle shaft bore;

a rotation plate secured to the spindle shaft for rotation therewith, the rotation plate having a radially extending yarn channel communicated with the upper end of the spindle shaft bore and with the lower end of the hollow spindle axial portion of the package top;

a pressurized air injector for injecting a pulse of air to effect a threading up of a yarn component delivered via the hollow spindle axial portion of the package top with another yarn component delivered via the spindle shaft bore, the pressurized air injector including a pressurized air supply conduit disposed within the spindle shaft such that the pulse of air injected by the pressurized air injector is operable to produce a suction flow in the hollow spindle axial portion of the package top and in the spindle shaft bore; and a radially extending pressurized air throughbore and the spindle shaft includes a ring chamber for passage of pressurized air therethrough to the injector.

4. The spindle according to claim 3, wherein the ring chamber is sealingly isolated in the spindle shaft with the exception of a surface thereof oriented interiorly toward the spindle shaft.

5. The spindle according to claim 3, wherein the ring chamber and the pressurized air supply conduit are disposed in the spindle shaft.

6. The spindle shaft according to claim 5, wherein the spindle shaft includes a portion at a lesser diameter than another portion adjacent thereto and the outer periphery of the lesser diameter portion defines a surface of the pressurized air supply conduit.

7. The spindle shaft according to claim 5, wherein the pressurized air supply conduit includes a radial segment communicating with the ring chamber and an axial segment sealed off with respect to the outer periphery of the spindle shaft and communicating with the radial segment.

8. The spindle shaft according to claim 3, wherein the ring chamber is disposed between an uppermost one of a radial bearing which rotatably supports the spindle shaft in the support hub and the rotation plate.

9. The spindle shaft according to claim 3, wherein the pressurized air supply conduit includes a radially outward end connected via a connecting conduit to a pressurized air source.

* * * * *